US010784574B2

(12) United States Patent
Liu et al.

(10) Patent No.: US 10,784,574 B2
(45) Date of Patent: Sep. 22, 2020

(54) ANTENNA

(71) Applicant: KUANG-CHI INSTITUTE OF ADVANCED TECHNOLOGY, Shenzhen (CN)

(72) Inventors: Ruopeng Liu, Shenzhen (CN); Tian Zhou, Shenzhen (CN); MuSen Li, Shenzhen (CN); Dong Wei, Shenzhen (CN)

(73) Assignee: Kuang-Chi Institute of Advanced Technology, Shenzhen (CN)

( * ) Notice: Subject to any disclaimer, the term of this patent is extended or adjusted under 35 U.S.C. 154(b) by 10 days.

(21) Appl. No.: 16/121,662

(22) Filed: Sep. 5, 2018

(65) Prior Publication Data

US 2018/0366823 A1 Dec. 20, 2018

Related U.S. Application Data

(63) Continuation of application No. PCT/CN2017/076109, filed on Mar. 9, 2017.

(51) Int. Cl.
*H01Q 19/10* (2006.01)
*H01Q 1/52* (2006.01)
(Continued)

(52) U.S. Cl.
CPC ..... *H01Q 1/528* (2013.01); *H01Q 1/42* (2013.01); *H01Q 15/0086* (2013.01);
(Continued)

(58) Field of Classification Search
CPC .. H01Q 15/0086; H01Q 17/001; H01Q 19/10; H01Q 19/108; H01Q 19/17;
(Continued)

(56) References Cited

U.S. PATENT DOCUMENTS 6,933,881 B2 * 8/2005 Shinoda ..... H01Q 1/3233 342/1
8,432,309 B2 * 4/2013 MacDonald ..... G01S 13/931 342/137
(Continued)

FOREIGN PATENT DOCUMENTS

CN 203589220 U 5/2014
CN 104347949 A 2/2015
(Continued)

OTHER PUBLICATIONS

Extended European Search Report for European Patent Application No. 17765760.8, dated Oct. 4, 2019, 10 pages.
(Continued)

*Primary Examiner* — Tho G Phan
(74) *Attorney, Agent, or Firm* — Armstrong Teasdale LLP

(57) ABSTRACT

The present invention relates to an antenna, which can improve a front-to-rear ratio and cross-polarization isolation without changing a structure of a reflection panel. The antenna includes an antenna element and a reflection panel. The antenna element is disposed on the reflection panel. The antenna further includes a wave-absorbing material layer. The wave-absorbing material layer is disposed on one side of an outer surface, back to the antenna element, of the reflection panel.

19 Claims, 13 Drawing Sheets

(51) Int. Cl.

| | |
|---|---|
| ***H01Q 21/24*** | (2006.01) |
| ***H01Q 19/17*** | (2006.01) |
| ***H01Q 15/00*** | (2006.01) |
| ***H01Q 17/00*** | (2006.01) |
| ***H01Q 21/06*** | (2006.01) |
| ***H01Q 1/42*** | (2006.01) |
| ***H01Q 25/00*** | (2006.01) |

(52) U.S. Cl.
CPC ..... *H01Q 17/001* (2013.01); *H01Q 17/004* (2013.01); *H01Q 19/10* (2013.01); *H01Q 19/17* (2013.01); *H01Q 21/065* (2013.01); *H01Q 21/24* (2013.01); *H01Q 25/001* (2013.01)

(58) Field of Classification Search
CPC ..... H01Q 1/42; H01Q 1/528; H01Q 21/065; H01Q 21/24; H01Q 17/004; H01Q 25/001
See application file for complete search history.

(56) References Cited

U.S. PATENT DOCUMENTS

| | | | | |
|---|---|---|---|---|
| 2005/0179610 | A1 | 8/2005 | Le et al. | |
| 2007/0241962 | A1* | 10/2007 | Shinoda | G01S 7/032 342/361 |
| 2011/0205528 | A1* | 8/2011 | Ogawa | G01N 21/3581 356/51 |
| 2012/0098723 | A1 | 4/2012 | Yamamoto et al. | |

FOREIGN PATENT DOCUMENTS

| | | | | | |
|---|---|---|---|---|---|
| CN | 104733870 | A | | 6/2015 | |
| CN | 204407519 | U | | 6/2015 | |
| CN | 205051003 | U | | 2/2016 | |
| CN | 105811118 | A | | 7/2016 | |
| GB | 2389235 | A | | 12/2003 | |
| JP | 2011142504 | A | * | 7/2011 | |
| KR | 20030039928 | A | * | 5/2003 | H01Q 1/246 |

OTHER PUBLICATIONS

Bagiante et al., Giant Electric Field Enhancement in Split Ring Resonators Featuring Nanometer-Sized Gaps, Scientific Reports (5:8051), Jan. 27, 2015, pp. 1-5.

Landy et al., Homogenization analysis of complementary waveguide metamaterials, Photonics and Nanostructures—Fundamentals and Applications 11 (2013), Jul. 23, 2013, pp. 453-467.

* cited by examiner

Comparison between a relationship in which reflectivity of a wave-absorbing metamaterial changes as an incident angle changes and a relationship in which reflectivity of a common wave-absorbing material changes as an incident angle changes in a TE mode

ANTENNA

CROSS REFERENCE TO RELATED APPLICATIONS

This application is a continuation of PCT/CN2017/076109 filed on Mar. 9, 2017, which claims priority to CN 201610149417.3 filed Mar. 16, 2016, both of which are incorporated herein by reference.

TECHNICAL FIELD

The present invention relates to the field of antennas, and in particular, to an antenna with improved electrical performance.

BACKGROUND

A front-to-rear ratio and cross polarization of an antenna are both important parameters for measuring antenna performance. The front-to-rear ratio of the antenna is a ratio of power flux density in a maximum radiation direction (0° as stipulated) of a main lobe to maximum power flux density near (in a range of 180°±20° as stipulated) an opposite direction in an antenna directivity diagram. The front-to-rear ratio indicates back lobe suppression performance of the antenna. A relatively low front-to-rear ratio of the antenna causes interference to a back area of the antenna. The cross polarization of the antenna means that there is a component in a direction in which an electric field vector of a radiation far field of the antenna is orthogonal to a main polarization direction.

In the prior art, to achieve an effect of improving a front-to-rear ratio and cross-polarization isolation, a reflection panel is modified, for example, an area of the reflection panel is increased, or complexity of an edge structure of the reflection panel is improved. However, an increase in a size of the reflection panel correspondingly increases a cross-sectional area of an antenna, and improvement on the complexity of the edge structure of the reflection panel increases processing difficulty and product costs.

SUMMARY

A technical problem to be resolved by the present invention is to provide an antenna, which can improve a front-to-rear ratio and cross-polarization isolation without changing a structure of a reflection panel.

To resolve the foregoing technical problem, a technical solution used in the present invention is an antenna, including an antenna element and a reflection panel. The antenna element is disposed on the reflection panel. The antenna further includes a wave-absorbing material layer. The wave-absorbing material layer is disposed on one side of an outer surface, back to the antenna element, of the reflection panel.

In an embodiment of the present invention, the wave-absorbing material layer is attached to the outer surface, back to the antenna element, of the reflection panel; or the wave-absorbing material layer is disposed on the outer surface, back to the antenna element, of the reflection panel with a spacing.

In an embodiment of the present invention, the antenna further includes a radome, the antenna element and the reflection panel are disposed in the radome, and the wave-absorbing material layer is disposed between the radome and the reflection panel.

In an embodiment of the present invention, the reflection panel has a base panel, a first side panel, and a second side panel; locations of the first side panel and the second side panel are opposite to each other; the antenna element is disposed on the base panel; the radome encloses at least the base panel, the first side panel, and the second side panel; and the wave-absorbing material layer is disposed at least between the radome and the first side panel and between the radome and the second side panel.

In an embodiment of the present invention, the wave-absorbing material layer is attached to an outer surface, opposite to the radome, of the first side panel, and is attached to an outer surface, opposite to the radome, of the second side panel; or the wave-absorbing material layer is attached to an inner surface, opposite to the first side panel and the second side panel, of the radome.

In an embodiment of the present invention, the wave-absorbing material layer is further disposed between the radome and the base panel.

In an embodiment of the present invention, the wave-absorbing material layer is attached to an outer surface, opposite to the radome, of the base panel; or the wave-absorbing material layer is attached to an inner surface, opposite to the base panel, of the radome.

In an embodiment of the present invention, the wave-absorbing material layer is combined with a metal layer, and the metal layer is disposed on the inner surface, opposite to the first side panel and the second side panel, of the radome.

In an embodiment of the present invention, the metal layer is further disposed on the inner surface, opposite to the base panel, of the radome.

In an embodiment of the present invention, there are a plurality of antenna elements that form an element array; the wave-absorbing material layer covers an outer surface of an area, on the reflection panel, that is corresponding to the element array; and layout of the wave-absorbing material layer is centered around the element array.

In an embodiment of the present invention, the wave-absorbing material layer includes a magnetic electromagnetic wave-absorbing material layer and a conductive geometric structure layer combined with the magnetic electromagnetic wave-absorbing material layer, the conductive geometric structure layer is formed by a plurality of conductive geometric structure units that are arranged sequentially, each conductive geometric structure unit includes an unclosed ring-shaped conductive geometric structure, and two relatively parallel strip-shaped structures are disposed at an opening of the ring-shaped conductive geometric structure.

In an embodiment of the present invention, the ring-shaped conductive geometric structure has more than one opening.

In an embodiment of the present invention, the ring-shaped conductive geometric structure is in a circular, oval, triangular, or polygonal shape.

In an embodiment of the present invention, a dielectric constant of the wave-absorbing material layer is 5-30, and magnetic permeability of the wave-absorbing material layer is 1-7.

In an embodiment of the present invention, the conductive geometric structure units are arranged in a form of a periodic array.

In an embodiment of the present invention, a metal layer is disposed on a surface of the magnetic electromagnetic wave-absorbing material layer.

In an embodiment of the present invention, the magnetic electromagnetic wave-absorbing material layer is a wave-absorbing patch material.

In an embodiment of the present invention, the conductive geometric structure units are attached to the magnetic electromagnetic wave-absorbing material layer or are embedded in the magnetic electromagnetic wave-absorbing material layer.

In an embodiment of the present invention, the magnetic electromagnetic wave-absorbing material layer includes a base and an absorbing agent combined with the base.

In an embodiment of the present invention, the conductive geometric structure unit is in a shape having a circumcircle, and a diameter of the circumcircle is 1/20-1/5 of an electromagnetic wavelength in an operating frequency band free space.

In an embodiment of the present invention, an operating frequency of the wave-absorbing material layer is within a frequency band of 0.8-2.7 GHz, a thickness of the conductive geometric structure unit is greater than a skin depth, corresponding to the operating frequency band, of the conductive geometric structure unit.

In an embodiment of the present invention, an operating frequency of the wave-absorbing material layer is within a frequency band of 0.8-2.7 GHz, and a thickness of the metal layer is greater than a skin depth, corresponding to the operating frequency band, of the metal layer.

In an embodiment of the present invention, line widths of the ring-shaped conductive geometric structure and the strip-shaped structure are both W, and 0.1 mm≤W≤1 mm.

In an embodiment of the present invention, thicknesses of the ring-shaped conductive geometric structure and the strip-shaped structure are both H, and 0.005 mm≤H≤0.05 mm.

Because the foregoing technical solutions are used in the present invention, compared with the prior art, the present invention can improve electrical performance of an antenna. Specific presentation is: The wave-absorbing material layer disposed on one side of the outer surface, back to the antenna element, of the reflection panel can absorb an electromagnetic wave that diffracts backward at an edge of the reflection panel of the antenna, so as to improve the front-to-rear ratio and the cross-polarization isolation of the antenna. In addition, a wave-absorbing material does not significantly increase additional costs of raw materials, and antenna installation is convenient, and does not increase difficulty with antenna assembly.

In the embodiments of the present invention, the wave-absorbing material layer includes the magnetic electromagnetic wave-absorbing material layer and the conductive geometric structure layer combined with the magnetic electromagnetic wave-absorbing material layer. The conductive geometric structure layer can absorb, in a centralized manner, electromagnetic waves at an operating frequency required by the wave-absorbing material layer, to facilitate absorption of the magnetic electromagnetic wave-absorbing material layer disposed below. In addition, the added metal layer reflects the absorbed electromagnetic waves to the magnetic electromagnetic wave-absorbing material layer for secondary absorption, to achieve a better wave-absorbing effect.

BRIEF DESCRIPTION OF DRAWINGS

To make the objectives, features, and advantages of the present invention easier to understand, the following describes, in detail, specific implementations of the present invention with reference to the accompanying drawings.

DESCRIPTION OF EMBODIMENTS

The following descriptions illustrate many specific details to help fully understand the present invention. However, the present invention may also be implemented in other manner different from a manner described herein. Therefore, the present invention is not limited to specific embodiments disclosed below.

The embodiments of the present invention describe an antenna, which can improve performance such as a front-to-rear ratio and cross polarization, reduce backward interference for a system to which the antenna is applied, reduce transmit/receive interference, and improve a communication capacity.

According to the embodiments of the present invention, a wave-absorbing material is introduced into the antenna, to absorb an electromagnetic wave that diffracts backward at an edge of a reflection panel of the antenna, so as to avoid a structural change to the reflection panel of the antenna.

The following describes the embodiments of the present invention in detail.

First Embodiment

Figure 1:
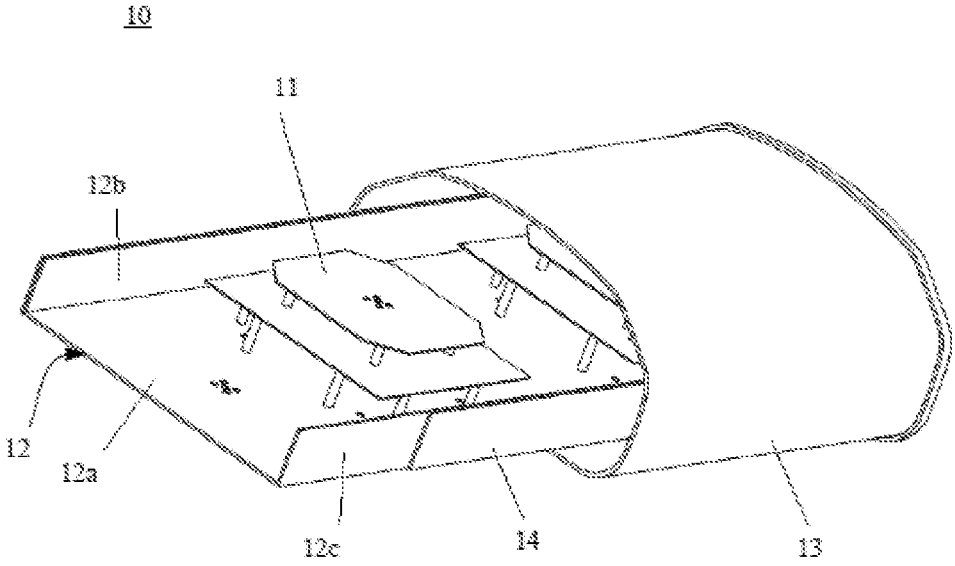
FIG. 1 is a solid structural diagram of an antenna according to a first embodiment of the present invention.

FIG. 1 is a solid structural diagram of an antenna according to a first embodiment of the present invention. Referring to FIG. 1, in this embodiment, the antenna 10 includes an antenna element 11, a reflection panel 12, a radome 13, and a wave-absorbing material layer 14.

The reflection panel 12 has a base panel 12*a*, a first side panel 12*b*, and a second side panel 12*c*. The first side panel 12*b* and the second side panel 12*c* are opposite to each other. The reflection panel 12 may further have a third side panel and a fourth side panel (not shown in the figure). The third side panel and the fourth side panel are opposite to each other. The third side panel is adjacent to the first side panel 12*b* and the second side panel 12*c*. The fourth side panel is also adjacent to the first side panel 12*b* and the second side panel 12*c*. For example, the first side panel 12*b* and the second side panel 12*c* may be in a regular rectangular shape, and the third side panel and the fourth side panel are in a shape obtained after a bevel is formed based on a rectangular shape. For example, one or more corners of the rectangular shape are cut, to form a beveled edge.

The antenna element 11 is disposed on the base panel 12*a*. In this embodiment, a form of the antenna element 11 and a manner of combining the antenna element 11 and the base panel 12*a* are not limited.

The radome 13 encloses at least the base panel 12*a*, the first side panel 12*b*, and the second side panel 12*c* of the reflection panel 12. In FIG. 1, a part of the radome is removed to make a structure of the reflection panel 12 visible. As shown in the figure, the radome 13 is not in contact with the reflection panel 12, but there is a spacing between the radome 13 and the entire reflection panel 12. It may be understood that the radome is optionally disposed, and the antenna 10 may not include the radome.

Theoretically, the wave-absorbing material layer 14 may be disposed on an outer surface, back to the antenna element 11, of the reflection panel 12. In an embodiment in which the radome 13 is disposed, the wave-absorbing material layer 14 is disposed between the radome 13 and the first side panel 12*b* of the reflection panel 12 and between the radome 13 and the second side panel 12*c*, to achieve expected wave-absorbing performance.

In this embodiment, the wave-absorbing material layer 14 is attached to an outer surface, opposite to the radome 13, of the first side panel 12*b*, and is attached to an outer surface, opposite to the radome 13, of the second side panel 12*c*. In this embodiment, a manner of connecting the wave-absorbing material layer 14 to the reflection panel may include bonding and riveting.

A wave-absorbing material is an important functional composite material, is first applied to military affairs, and may reduce a radar cross section of a military target. With development of science and technology, an electronic component becomes increasingly integrated, small-sized, and high-frequency, and the wave-absorbing material is more widely applied in the civilian field, for example, used as a microwave anechoic chamber material, a component of a micro attenuator, or a microwave molding processing technology.

The wave-absorbing material is usually a composite material manufactured by mixing a base material and a wave-absorbing agent. The base material mainly includes a coating type, a ceramic type, a rubber type, and a plastic type. The wave-absorbing agent mainly includes an inorganic ferromagnetic substance, a ferromagnetic substance, a conducting polymer, a carbon-based material, and the like.

The wave-absorbing material may be a wave-absorbing metamaterial described in a first to a fourth preferred embodiments.

In this embodiment, parameters of the wave-absorbing material are: Vertical incident reflectivity R is less than −1 dB at 1 GHz and is less than −3 dB at 2 GHz. A dielectric constant is 5-30. Magnetic permeability is 1-7.

Regarding a coverage area, the wave-absorbing material layer 14 can cover an outer surface of an area, of the reflection panel, that includes an element array, and layout of the wave-absorbing material layer 14 is centered around the element array.

Second Embodiment

Figure 2:
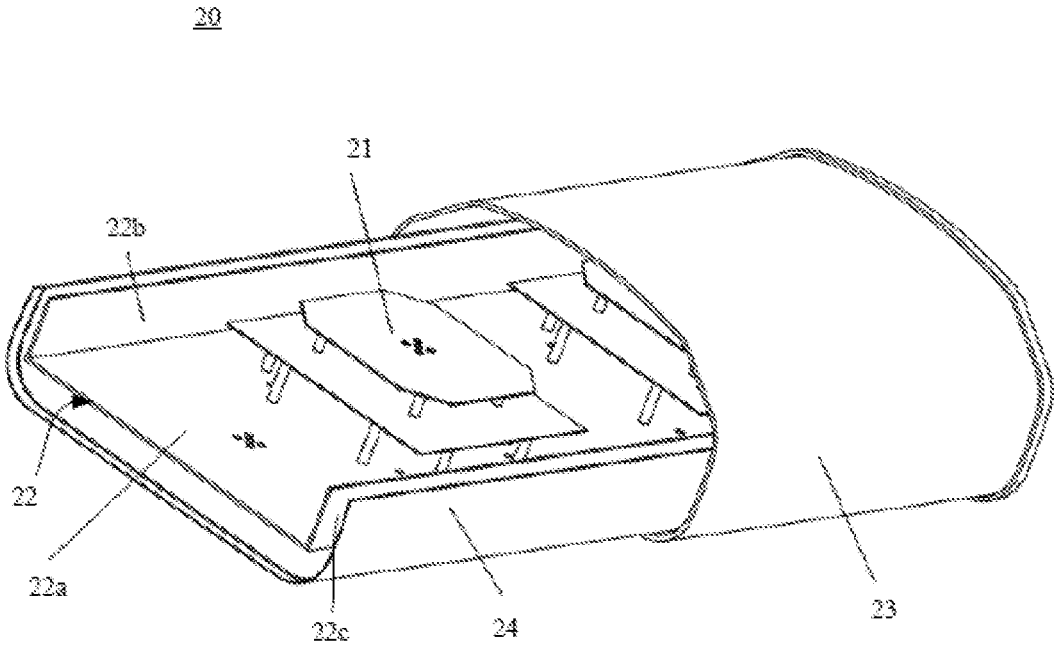
FIG. 2 is a solid structural diagram of an antenna according to a second embodiment of the present invention.

FIG. 2 is a solid structural diagram of an antenna according to a second embodiment of the present invention. Referring to FIG. 2, in this embodiment, the antenna 20 includes an antenna element 21, a reflection panel 22, a radome 23, and a wave-absorbing material layer 24.

The reflection panel 22 has a base panel 22*a*, a first side panel 22*b*, and a second side panel 22*c*. The first side panel 22*b* and the second side panel 22*c* are opposite to each other. The reflection panel 22 may further have a third side panel and a fourth side panel (not shown in the figure). The third side panel and the fourth side panel are opposite to each other. The third side panel is adjacent to the first side panel 22*b* and the second side panel 22*c*. The fourth side panel is also adjacent to the first side panel 22*b* and the second side panel 22*c*. For example, the first side panel 22*b* and the second side panel 22*c* may be in a regular rectangular shape, and the third side panel and the fourth side panel are in a shape obtained after a bevel is formed based on a rectangular shape.

The antenna element 21 is disposed on the base panel 22*a*. In this embodiment, a form of the antenna element 21 and a manner of combining the antenna element 21 and the base panel 22*a* are not limited.

The radome 23 encloses at least the base panel 22*a*, the first side panel 22*b*, and the second side panel 22*c* of the reflection panel 22. In FIG. 2, a part of the radome is removed to make a structure of the reflection panel 22 visible. As shown in the figure, the radome 23 is not in contact with the reflection panel 22, but there is a spacing between the radome 23 and the entire reflection panel 22. It may be understood that the radome is optionally disposed, and the antenna 20 may not include the radome.

Theoretically, the wave-absorbing material layer 24 may be disposed on an outer surface, back to the antenna element 21, of the reflection panel 22. In an embodiment in which the radome 23 is disposed, the wave-absorbing material layer 24 is disposed between the radome 23 and the first side panel 22*b* of the reflection panel 22 and between the radome 23 and the second side panel 22*c*, to achieve expected wave-absorbing performance.

In this embodiment, the wave-absorbing material layer 24 is attached to the radome 23, and is located on an inner surface, opposite to the first side panel 22*b* and the second side panel 22*c*, of the radome 23. To achieve a better effect, the wave-absorbing material layer 24 is further located on an inner surface, opposite to the base panel 22*a*, of the radome 23. Herein, a manner of connecting the wave-absorbing material layer 24 to the radome 23 may include bonding or riveting. Alternatively, a surface of a bonding part of the radome 23 and the wave-absorbing material layer 24 may be metalized before the wave-absorbing material layer 24 is bonded. A groove may be provided inside the radome 23, to place a wave-absorbing material.

The wave-absorbing material may be a wave-absorbing metamaterial described in a first to a fourth preferred embodiments.

In this embodiment, parameters of the wave-absorbing material are: Vertical incident reflectivity R is less than −1 dB at 1 GHz and is less than −3 dB at 2 GHz. A dielectric constant is 5-30. Magnetic permeability is 1-7.

Regarding a coverage area, the wave-absorbing material layer 24 can cover an outer surface of an area, of the reflection panel, that includes an element array, and layout of the wave-absorbing material layer 24 is centered around the element array.

Third Embodiment

Figure 3:
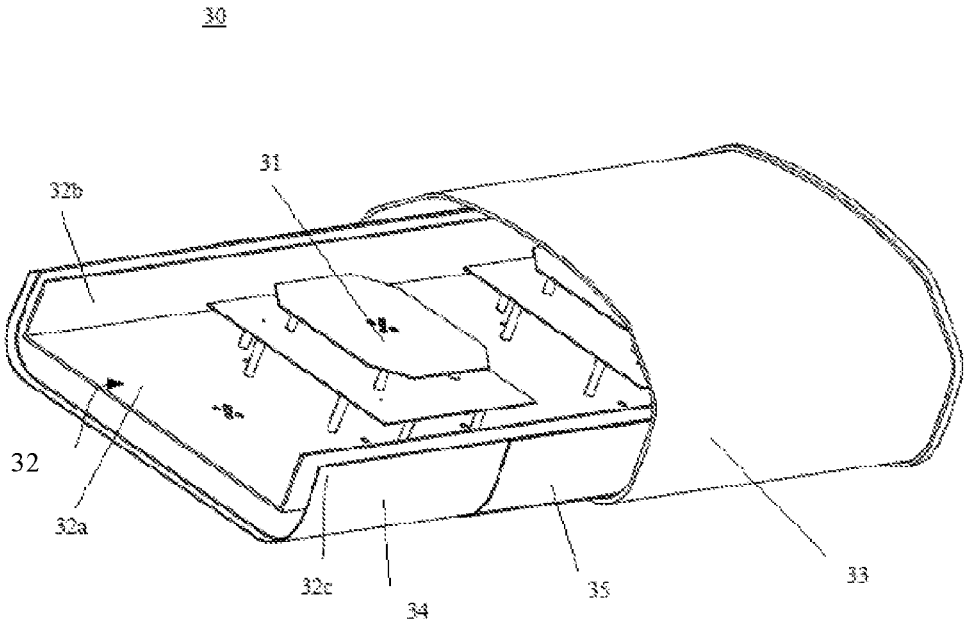
FIG. 3 is a solid structural diagram of an antenna according to a third embodiment of the present invention.

FIG. 3 is a solid structural diagram of an antenna according to a third embodiment of the present invention. Referring to FIG. 3, in this embodiment, the antenna 30 includes an antenna element 31, a reflection panel 32, a radome 33, and a wave-absorbing material layer 34.

The reflection panel 32 has a base panel 32*a*, a first side panel 32*b*, and a second side panel 32*c*. The first side panel 32*b* and the second side panel 32*c* are opposite to each other. The reflection panel 32 may further have a third side panel and a fourth side panel (not shown in the figure). The third side panel and the fourth side panel are opposite to each other. The third side panel is adjacent to the first side panel 32*b* and the second side panel 32*c*. The fourth side panel is also adjacent to the first side panel 32*b* and the second side panel 32*c*. For example, the first side panel 32*b* and the second side panel 32*c* may be in a regular rectangular shape, and the third side panel and the fourth side panel are in a shape obtained after a bevel is formed based on a rectangular shape.

The antenna element 31 is disposed on the base panel 32*a*. In this embodiment, a form of the antenna element 31 and a manner of combining the antenna element 31 and the base panel 32*a* are not limited.

The radome 33 encloses at least the base panel 32*a*, the first side panel 32*b*, and the second side panel 32*c* of the reflection panel 32. In FIG. 3, a part of the radome is removed to make a structure of the reflection panel 32 visible. As shown in the figure, the radome 33 is not in contact with the reflection panel 32, but there is a spacing between the radome 33 and the entire reflection panel 32. It may be understood that the radome is optionally disposed, and the antenna 30 may not include the radome.

Theoretically, the wave-absorbing material layer 34 may be disposed on an outer surface, back to the antenna element 31, of the reflection panel 32. In an embodiment in which the radome 33 is disposed, the wave-absorbing material layer 34 is disposed between the radome 33 and the first side panel 32*b* of the reflection panel 32 and between the radome 33 and the second side panel 32*c*, to achieve expected wave-absorbing performance.

In this embodiment, the wave-absorbing material layer 34 is combined with a metal layer 35, and the metal layer 35 is located on an inner surface, opposite to the first side panel 32*b* and the second side panel 32*c*, of the radome 33. To achieve a better effect, the metal layer 35 is further located on an inner surface, opposite to the base panel 32*a*, of the radome 33. Herein, a manner of connecting the wave-absorbing material layer 34 to the metal layer 35 may include bonding and riveting. A manner of connecting the metal layer 35 to the radome 33 may include bonding and riveting. A groove may be provided inside the radome 33, to place the metal layer 35 and the wave-absorbing material layer 34. The metal layer may be, for example, copper foil.

A wave-absorbing material may be a wave-absorbing metamaterial described in a first to a fourth preferred embodiments.

In this embodiment, parameters of the wave-absorbing material are: Vertical incident reflectivity R is less than −1 dB at 1 GHz and is less than −3 dB at 2 GHz. A dielectric constant is 5-30. Magnetic permeability is 1-7.

Regarding a coverage area, the wave-absorbing material layer 34 can cover an outer surface of an area, of the reflection panel, that includes an element array, and layout of the wave-absorbing material layer 34 is centered around the element array.

In the following, a grid is formed by lines connecting adjacent nodes, where a center of a conductive geometric structure unit is used as a node. The grid is used to describe layout regularity of conductive geometric structure units.

First Preferred Embodiment

Figure 10:
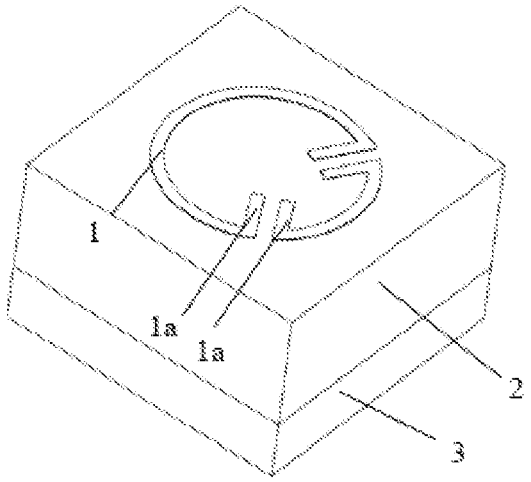
FIG. 10 is a schematic diagram of a unit of an electromagnetic wave-absorbing metamaterial according to a first preferred embodiment of the present invention.
Figure 11:
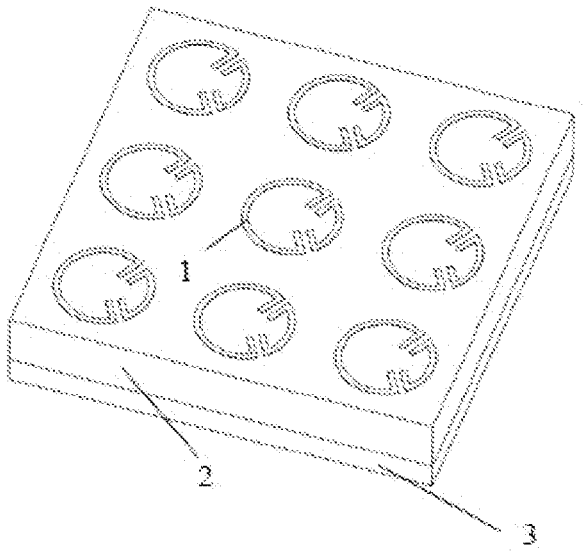
FIG. 11 is a schematic diagram of layout regularity of a plurality of units of an electromagnetic wave-absorbing metamaterial according to a first preferred embodiment of the present invention.

As shown in FIG. 10, a wave-absorbing metamaterial includes a magnetic electromagnetic wave-absorbing material layer 2 and conductive geometric structure units 1 combined with the magnetic electromagnetic wave-absorbing material layer 2. The magnetic electromagnetic wave-absorbing material layer 2 may be formed by rubber, as a base, combined with an electromagnetic wave absorbing agent. The electromagnetic wave absorbing agent may be a granular ferrite, a micron/submicron metal particle absorbing agent, a magnetic fiber absorbing agent, or a nano magnetic absorbing agent, and may be combined with the rubber base by means of doping or configuration. The magnetic electromagnetic wave-absorbing material layer 2 may be a wave-absorbing patch material, has a relatively small thickness, and can be produced in an automated manner. The thickness and electromagnetic parameters of the magnetic electromagnetic wave-absorbing material layer 2 may be set based on an operating frequency band of the wave-absorbing metamaterial. The operating frequency band is 0.8-2.7 GHz, a dielectric constant of the wave-absorbing metamaterial is 5-30, and magnetic permeability of the wave-absorbing metamaterial is 1-7. In this case, vertical incident reflectivity R is less than −1 dB at 1 GHz and is less than −3 dB at 2 GHz. The conductive geometric structure units 1 each is in a circular shape with two openings. Parallel metal strips 1*a* are disposed at the openings. As shown in FIG. 11, layout regularity of the conductive geometric structure units 1 is periodic regularity. The periodic regularity is periodic layout in two perpendicular directions in a plane, with extension in a form of a square grid. However, the layout regularity is not limited thereto, and may be staggered layout, unordered layout, or uneven layout. A metal layer 3 may be further disposed on a rear side of the magnetic electromagnetic wave-absorbing material layer 2. The metal layer 3 is optionally disposed, and in some application scenarios, the metal layer 3 may be omitted. For example, in the third embodiment, because the wave-absorbing material layer has been attached to the metal layer, no metal layer is disposed inside the wave-absorbing material layer. A material of the conductive geometric structure units 1 may be copper, silver, or gold. A thickness of the conductive geometric structure units 1 is greater than a skin depth of the operating frequency band. Line widths of the conductive geometric structure units 1 and the metal strips 1*a* are both W, and thicknesses thereof are both H. Settings may be as follows: 0.1 mm≤W≤1 mm, and 0.005 mm≤H≤0.05 mm. Within this size range, the conductive geometric structure units 1 have a good wave-absorbing effect. The conductive geometric structure units 1 each is in a shape having a circumcircle, and a diameter of the circumcircle may be set to be 1/20-1/5 of an electromagnetic wavelength in an operating frequency band free space. The circumcircle of the conductive geometric structure unit 1 is a circle limited by the conductive geometric structure unit 1. In another embodiment, the circumcircle may be a circle limited by an outermost endpoint. A thickness of the metal layer 3 may be set to be greater than a skin depth of a corresponding operating frequency band. When a current with a quite high frequency passes a conductor, it may be considered that the current passes only a quite thin layer on a surface of the conductor. A thickness of the quite thin layer is the skin depth. When the thickness of the metal layer 3 is set with reference to the skin depth, a material in a center part of the conductor may be omitted.

The conductive geometric structure units 1 may be fastened to the magnetic electromagnetic wave-absorbing material layer 2 by using a thin film or by means of patching, or may be embedded in the magnetic electromagnetic wave-absorbing material layer 2. The magnetic electromagnetic wave-absorbing material layer 2 may be fastened to the metal layer 3 by means of bonding or in another manner.

Figure 12:
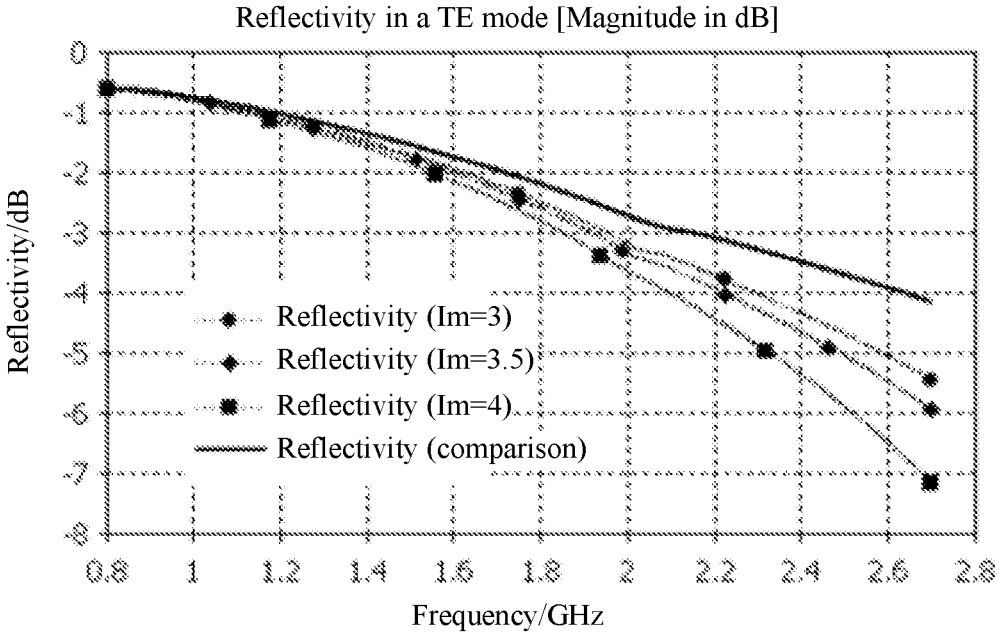
FIG. 12 is a curve diagram of reflectivity of an electromagnetic wave-absorbing metamaterial in a TE mode according to a first preferred embodiment of the present invention.

A TE wave is a transverse wave in an electromagnetic wave. As shown in FIG. 12, for reflectivity in a TE mode, after the conductive geometric structure units are added, the vertical incident reflectivity of the material decreases. When a diameter 1 m of the conductive geometric structure units 1 is 3 micrometers, the reflectivity of the wave-absorbing metamaterial shown in FIG. 11 is lower than reflectivity of a magnetic electromagnetic wave-absorbing material layer with no conductive geometric structure unit. When the diameter 1 m of the conductive geometric structure units 1 is 3.5 micrometers, the reflectivity of the wave-absorbing metamaterial further decreases. When the diameter 1 m of the conductive geometric structure units is 4 micrometers, the reflectivity of the wave-absorbing metamaterial is the lowest. An operating frequency band shown in FIG. 12 is 0.8-2.7 GHz.

Figure 13:
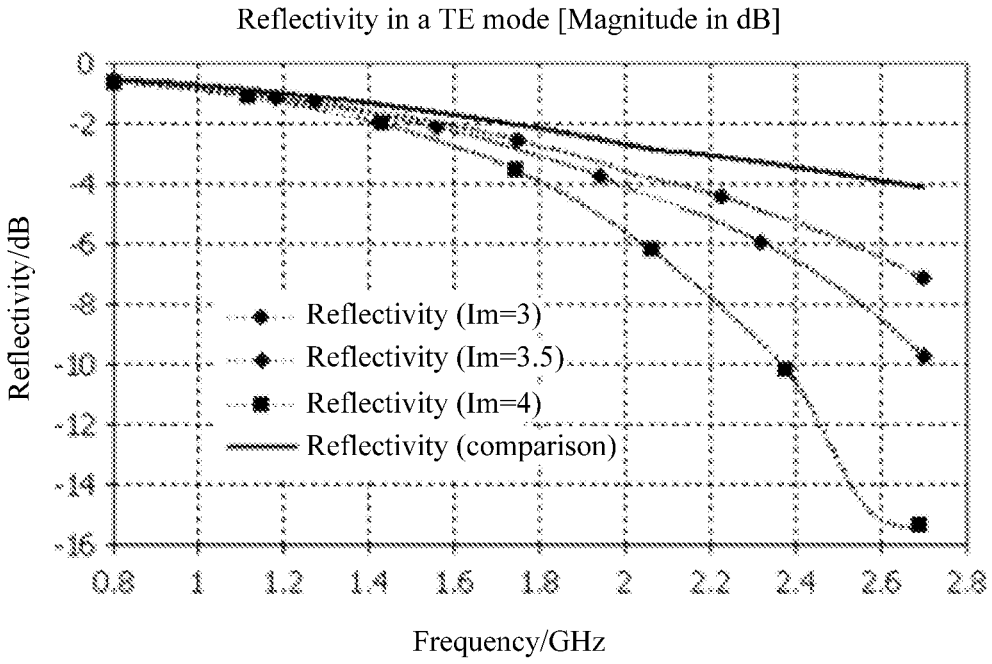
FIG. 13 is a curve diagram of reflectivity of an electromagnetic wave-absorbing metamaterial in a TM mode according to a first preferred embodiment of the present invention.

A TM wave is a longitudinal wave in an electromagnetic wave. As shown in FIG. 13, for reflectivity in a TM mode, after the conductive geometric structure units are added, the vertical incident reflectivity of the material decreases. When a diameter 1 m of the conductive geometric structure units 1 is 3 micrometers, the reflectivity of the wave-absorbing metamaterial shown in FIG. 11 is lower than reflectivity of a magnetic electromagnetic wave-absorbing material layer with no conductive geometric structure unit. When the diameter 1 m of the conductive geometric structure units 1 is 3.5 micrometers, the reflectivity of the wave-absorbing metamaterial further decreases. When the diameter 1 m of the conductive geometric structure units is 4 micrometers, the reflectivity of the wave-absorbing metamaterial is the lowest. An operating frequency band shown in FIG. 13 is 0.8-2.7 GHz. It should be noted that an embodiment according to the present invention is not limited to a specific operating frequency, but an electromagnetic microstructure may be correspondingly designed based on a specified operating frequency and a used wave-absorbing material.

Second Preferred Embodiment

Component numbers and partial content of the foregoing embodiments are still used in this embodiment. A same number is used to represent a same or similar component, and descriptions of same technical content are selectively omitted. For descriptions of an omitted part, refer to the foregoing embodiments. Details are not repeatedly described in this embodiment.

Figure 14:
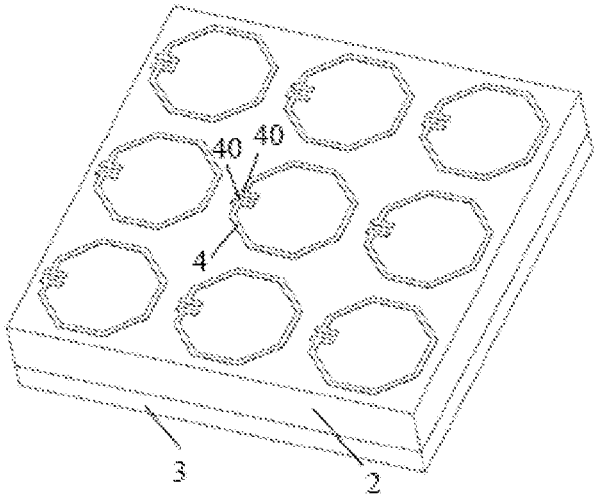
FIG. 14 is a schematic diagram of layout regularity of a plurality of units of an electromagnetic wave-absorbing metamaterial according to a second preferred embodiment of the present invention.

As shown in FIG. 14, a difference from the first preferred embodiment is: Conductive geometric structure units 4 each is in an octagonal shape with an opening, and parallel metal strips 40 are disposed at the opening. As shown in FIG. 14, layout regularity of the conductive geometric structure units 4 is periodic regularity. The periodic regularity is periodic layout in two perpendicular directions in a plane, with extension in a form of a square grid. However, the layout regularity is not limited thereto, and may be staggered layout, unordered layout, or uneven layout. A diameter of a circumcircle of the conductive geometric structure units 4 each may be set to be 1/20-1/5 of an electromagnetic wavelength in an operating frequency band free space.

Figure 15:
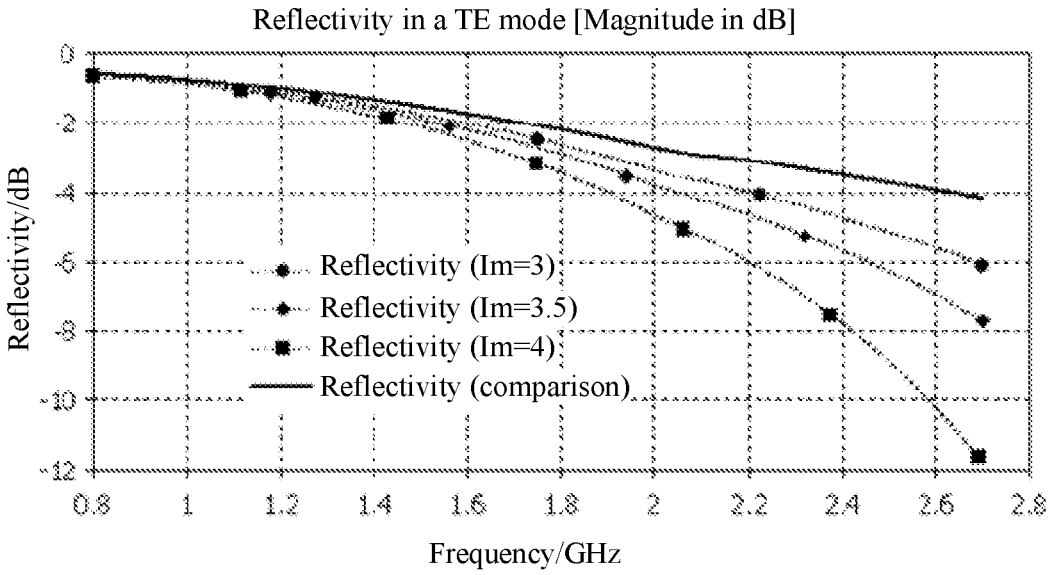
FIG. 15 is a curve diagram of reflectivity of an electromagnetic wave-absorbing metamaterial in a TE mode according to a second preferred embodiment of the present invention.

As shown in FIG. 15, for reflectivity in a TE mode, after the conductive geometric structure units are added, vertical incident reflectivity of a material decreases. When a diameter 1 m of the conductive geometric structure units 4 is 3 micrometers, reflectivity of a wave-absorbing metamaterial shown in FIG. 14 is lower than reflectivity of a magnetic electromagnetic wave-absorbing material layer with no conductive geometric structure unit. When the diameter 1 m of the conductive geometric structure units 4 is 3.5 micrometers, the reflectivity of the wave-absorbing metamaterial further decreases. When the diameter 1 m of the conductive geometric structure units is 4 micrometers, the reflectivity of the wave-absorbing metamaterial is the lowest. An operating frequency band shown in FIG. 15 is 0.8-2.7 GHz.

Figure 16:
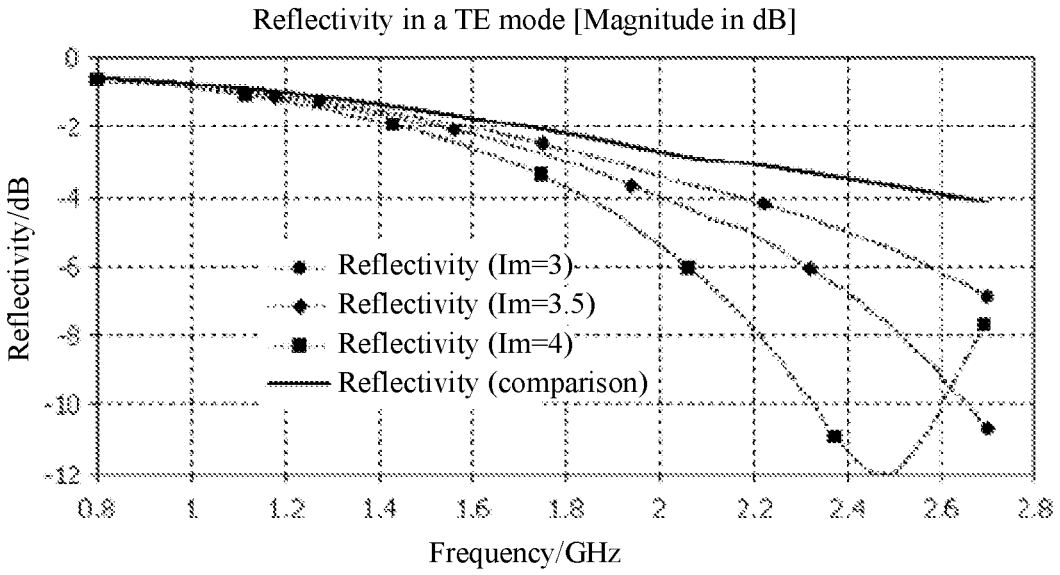
FIG. 16 is a curve diagram of reflectivity of an electromagnetic wave-absorbing metamaterial in a TM mode according to a second preferred embodiment of the present invention.

As shown in FIG. 16, for reflectivity in a TM mode, after the conductive geometric structure units are added, vertical incident reflectivity of a material decreases. When a diameter 1 m of the conductive geometric structure units 4 is 3 micrometers, reflectivity of a wave-absorbing metamaterial shown in FIG. 14 is lower than reflectivity of a magnetic electromagnetic wave-absorbing material layer with no conductive geometric structure unit. When the diameter 1 m of the conductive geometric structure units 4 is 3.5 micrometers, the reflectivity of the wave-absorbing metamaterial further decreases. When the diameter 1 m of the conductive geometric structure units 4 is 4 micrometers, the reflectivity of the wave-absorbing metamaterial is the lowest. An operating frequency band shown in FIG. 16 is 0.8-2.7 GHz.

Third Preferred Embodiment

Component numbers and partial content of the foregoing embodiments are still used in this embodiment. A same number is used to represent a same or similar component, and descriptions of same technical content are selectively omitted. For descriptions of an omitted part, refer to the foregoing embodiments. Details are not repeatedly described in this embodiment.

Figure 17:
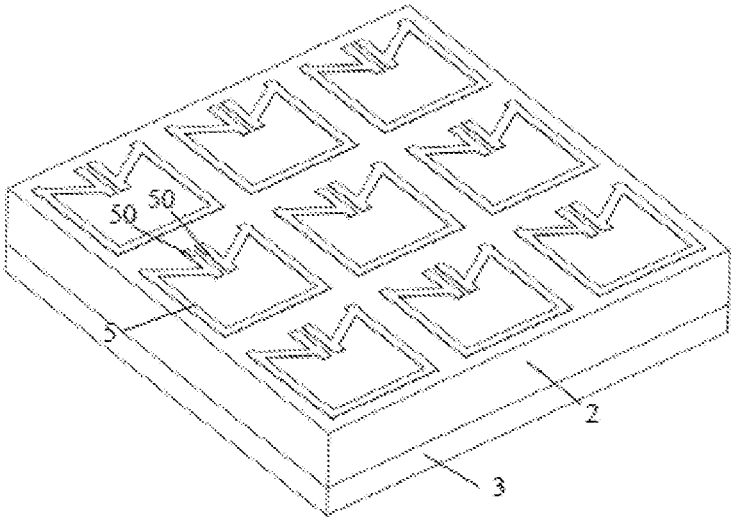
FIG. 17 is a schematic diagram of layout regularity of a plurality of units of an electromagnetic wave-absorbing metamaterial according to a third preferred embodiment of the present invention.

As shown in FIG. 17, a difference from the first preferred embodiment is: Conductive geometric structure units 5 each is in an quadrangular shape with an opening, and parallel metal strips 50 are disposed at the opening. A center location of an edge at which the opening is located moves to inside the quadrangular shape. As shown in FIG. 17, layout regularity of the conductive geometric structure units 5 is periodic regularity. The periodic regularity is periodic layout in two perpendicular directions in a plane, with extension in a form of a square grid. However, the layout regularity is not limited thereto, and may be staggered layout, unordered layout, or uneven layout. A diameter of a circumcircle of the conductive geometric structure units 5 each may be set to be 1/20-1/5 of an electromagnetic wavelength in an operating frequency band free space.

Figure 18:
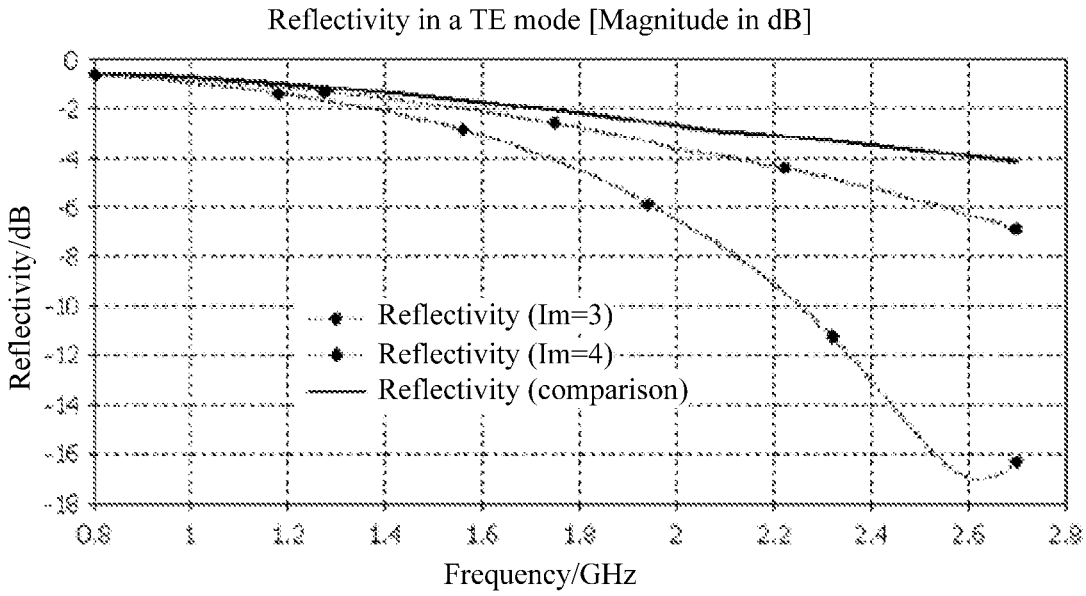
FIG. 18 is a curve diagram of reflectivity of an electromagnetic wave-absorbing metamaterial in a TE mode according to a third preferred embodiment of the present invention.

As shown in FIG. 18, for reflectivity in a TE mode, after the conductive geometric structure units are added, vertical incident reflectivity of a material decreases. When a diameter 1 m of the conductive geometric structure units 5 is 3 micrometers, reflectivity of a wave-absorbing metamaterial shown in FIG. 17 is lower than reflectivity of a magnetic electromagnetic wave-absorbing material layer with no conductive geometric structure unit. When the diameter 1 m of the conductive geometric structure units 5 is 3.5 micrometers, the reflectivity of the wave-absorbing metamaterial further decreases. When the diameter 1 m of the conductive geometric structure units is 4 micrometers, the reflectivity of the wave-absorbing metamaterial is the lowest. An operating frequency band shown in FIG. 18 is 0.8-2.7 GHz.

Figure 19:
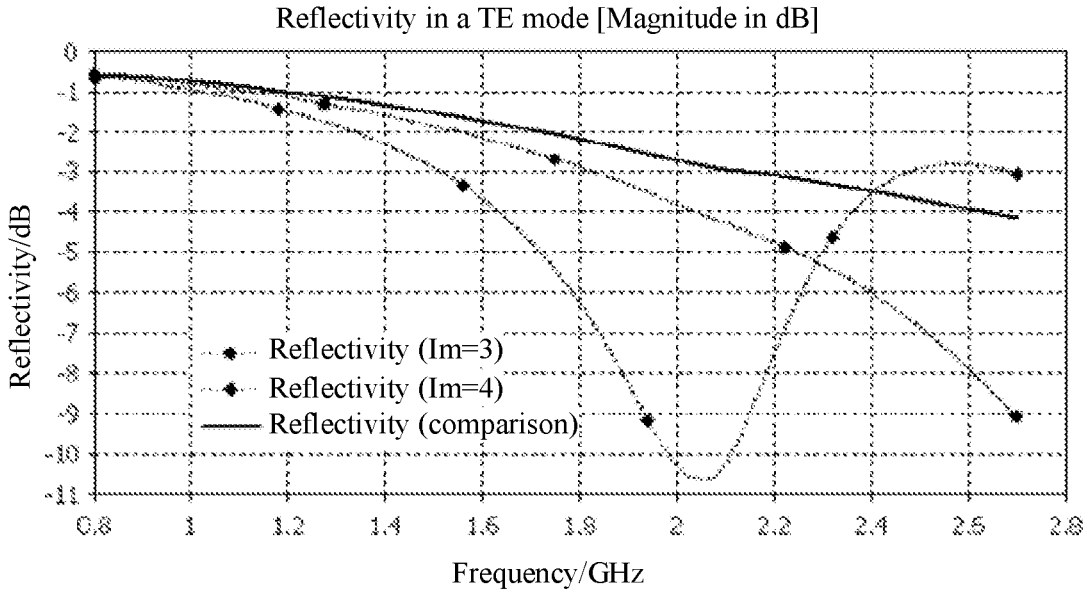
FIG. 19 is a curve diagram of reflectivity of an electromagnetic wave-absorbing metamaterial in a TM mode according to a third preferred embodiment of the present invention.

As shown in FIG. 19, for reflectivity in a TM mode, after the conductive geometric structure units are added, vertical incident reflectivity of a material decreases. When a diameter 1 m of the conductive geometric structure units 5 is 3 micrometers, reflectivity of a wave-absorbing metamaterial shown in FIG. 17 is lower than reflectivity of a magnetic electromagnetic wave-absorbing material layer with no conductive geometric structure unit. When the diameter 1 m of the conductive geometric structure units 5 is 3.5 micrometers, the reflectivity of the wave-absorbing metamaterial further decreases. When the diameter 1 m of the conductive geometric structure units 5 is 4 micrometers, the reflectivity of the wave-absorbing metamaterial is the lowest. An operating frequency band shown in FIG. 19 is 0.8-2.7 GHz.

Fourth Preferred Embodiment

Component numbers and partial content of the foregoing embodiment are still used in this embodiment. A same number is used to represent a same or similar component, and descriptions of same technical content are selectively omitted. For descriptions of an omitted part, refer to the foregoing embodiments. Details are not repeatedly described in this embodiment.

Figure 20:
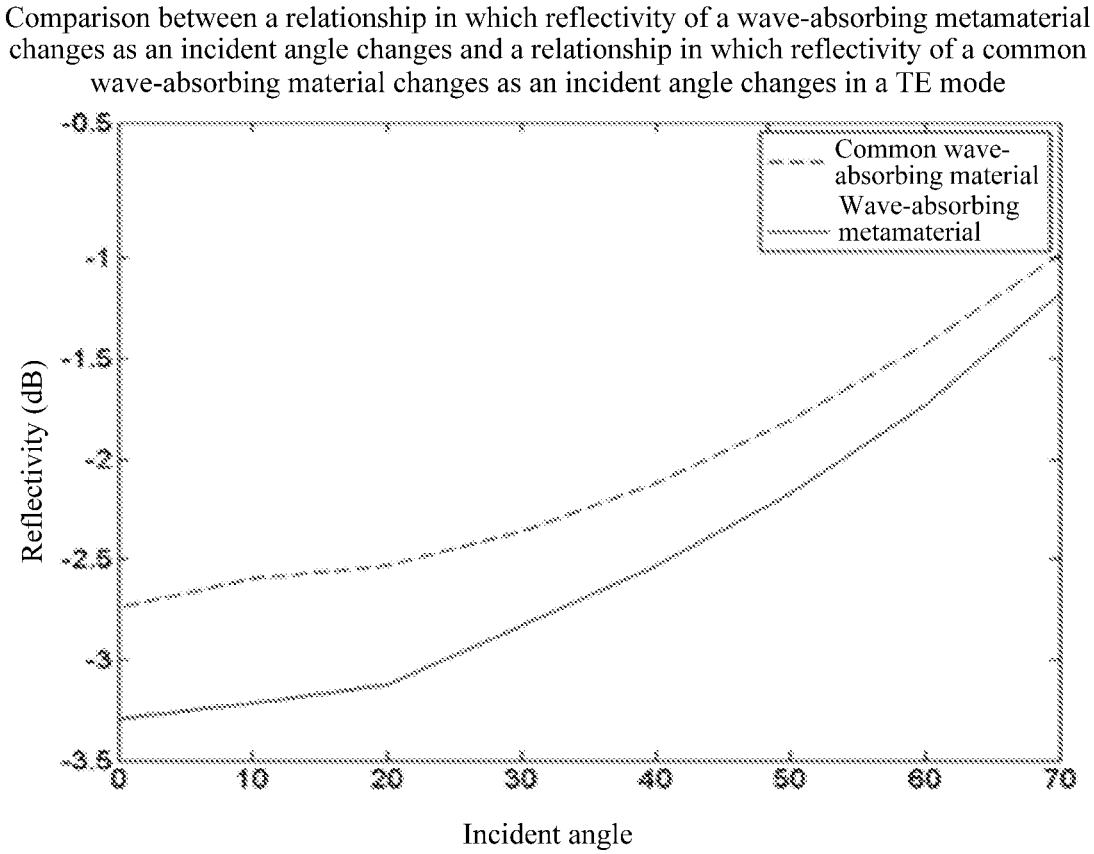
FIG. 20 is a curve diagram of reflectivity of an electromagnetic wave-absorbing metamaterial in a TE mode according to a fourth preferred embodiment of the present invention.

In this embodiment, the wave-absorbing metamaterial in the third preferred embodiment or a wave-absorbing metamaterial similar to that in the third preferred embodiment is used. As shown in FIG. 20, for reflectivity in a TE mode, after conductive geometric structure units are added, large-angle incident reflectivity of the material decreases. When the wave-absorbing metamaterial with the conductive geometric structure units 5 is used, the reflectivity of the wave-absorbing metamaterial shown in FIG. 17 is lower than reflectivity of a magnetic electromagnetic wave-absorbing material layer with no conductive geometric structure unit. Even for large-angle incidence at 50 degrees, 60 degrees, or 70 degrees, the reflectivity obviously decreases. Although it is not shown in the figure, the reflectivity also decreases when an incident angle is 85 degrees.

Figure 21:
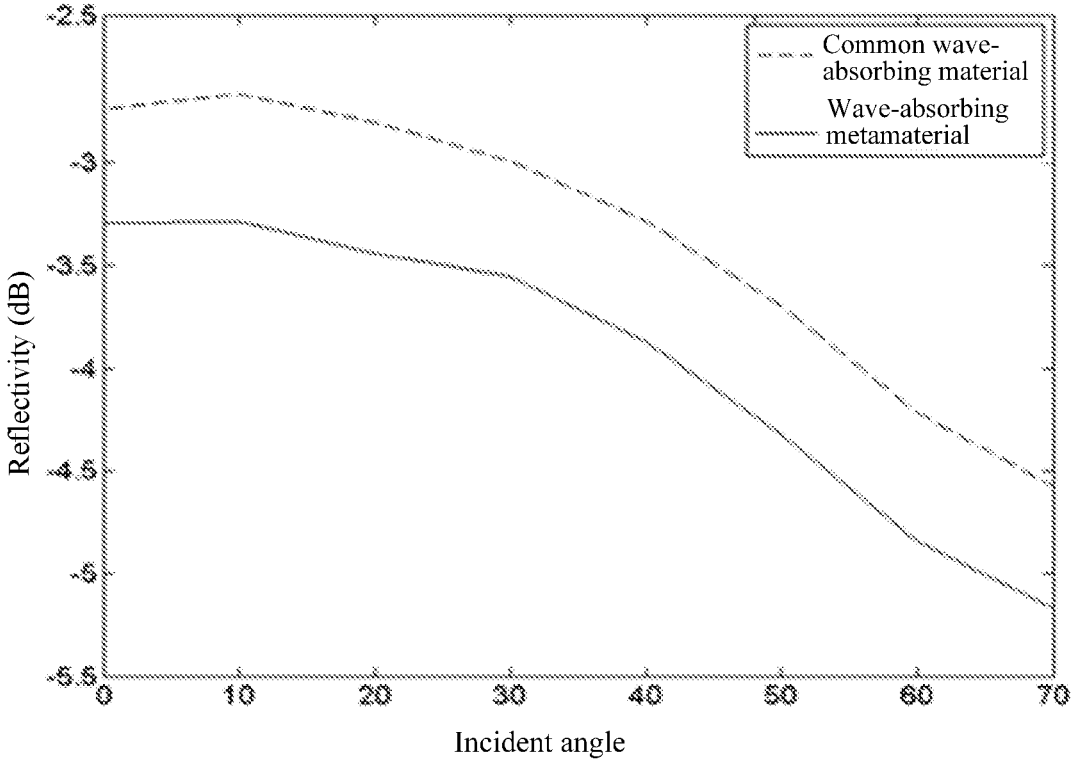
FIG. 21 is a curve diagram of reflectivity of an electromagnetic wave-absorbing metamaterial in a TM mode according to a fourth preferred embodiment of the present invention.

As shown in FIG. 21, for reflectivity in a TM mode, after conductive geometric structure units are added, large-angle incident reflectivity of the material decreases. When the wave-absorbing metamaterial with the conductive geometric structure units 5 is used, the reflectivity of the wave-absorbing metamaterial shown in FIG. 17 is lower than reflectivity of a magnetic electromagnetic wave-absorbing material layer with no conductive geometric structure unit. Even for large-angle incidence at 50 degrees, 60 degrees, or 70 degrees, the reflectivity obviously decreases. Although it is not shown in the figure, the reflectivity also decreases when an incident angle is 85 degrees.

In the prior art, for a case in which "an electromagnetic wave is severely reflected on a surface of a wave-absorbing material, thereby degrading absorption of the electromagnetic wave, and reflection is severer under a condition of large-angle incidence", usually, a plurality of layers of wave-absorbing materials are used in the industry, or a gradient electromagnetic parameter change is implemented in a wave-absorbing material, to implement better impedance matching and reduce surface reflection. However, multi-layer wave absorbing brings an increase in product surface density, more installation space is required, and complexity of production, manufacturing, and inspection increases. Process complexity of a gradient-changing wave-absorbing material increases, increasing difficulty with process control and usually causing degradation in product consistency.

In the foregoing embodiment, the ring-shaped conductive geometric structure in the conductive geometric structure unit is equivalent to an inductor L in a circuit, the two relatively parallel strip-shaped structures are equivalent to a capacitor C in the circuit, and the ring-shaped conductive geometric structure and the strip-shaped structures are combined to form an LC circuit. FIG. 10 is equivalent to a series connection of two inductors and two capacitors. By adjusting a size of the conductive geometric structure unit to change electromagnetic parameter performance of the conductive geometric structure unit, a required effect can be achieved, namely, electromagnetic waves at an operating frequency required by the wave-absorbing metamaterial can be absorbed in a centralized manner, to facilitate absorption of the magnetic electromagnetic wave-absorbing material layer disposed below. In addition, the added metal layer reflects the absorbed electromagnetic waves to the magnetic electromagnetic wave-absorbing material layer for secondary absorption. According to the embodiments of the present invention, reflection of a wave-absorbing material in cases of vertical incidence and large-angle incidence of electromagnetic waves may be reduced. Based on electromagnetic features of a conventional wave-absorbing material, a topological structure and layout regularity of an electromagnetic metamaterial are changed to modify electromagnetic parameters of the electromagnetic metamaterial in an operating frequency band and overall equivalent electromagnetic parameters, so as to achieve an effect of reducing reflectivity. In addition, only one layer of wave-absorbing material is required. Therefore, a wave-absorbing effect equivalent to that of the prior art can be achieved with a smaller thickness, namely, an absorbing effect equivalent to that of a conventional material is achieved with lower surface density.

Figure 4:
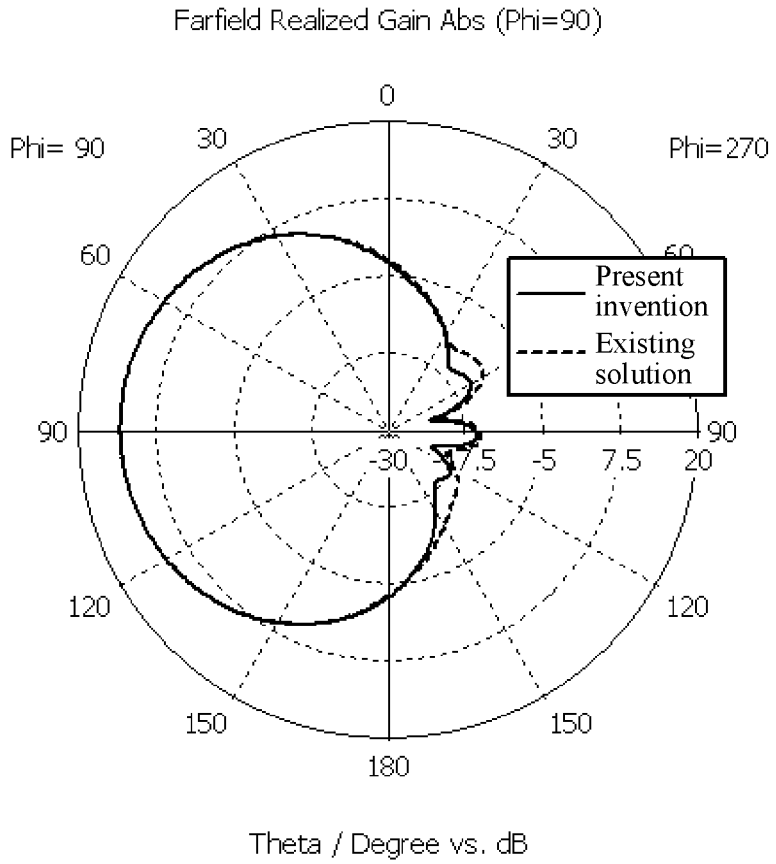
FIG. 4 is a comparison between a directivity diagram of an antenna with a wave-absorbing material according to an embodiment of the present invention and a directivity diagram of an existing antenna with no wave-absorbing material at 1710 MHz.
Figure 5:
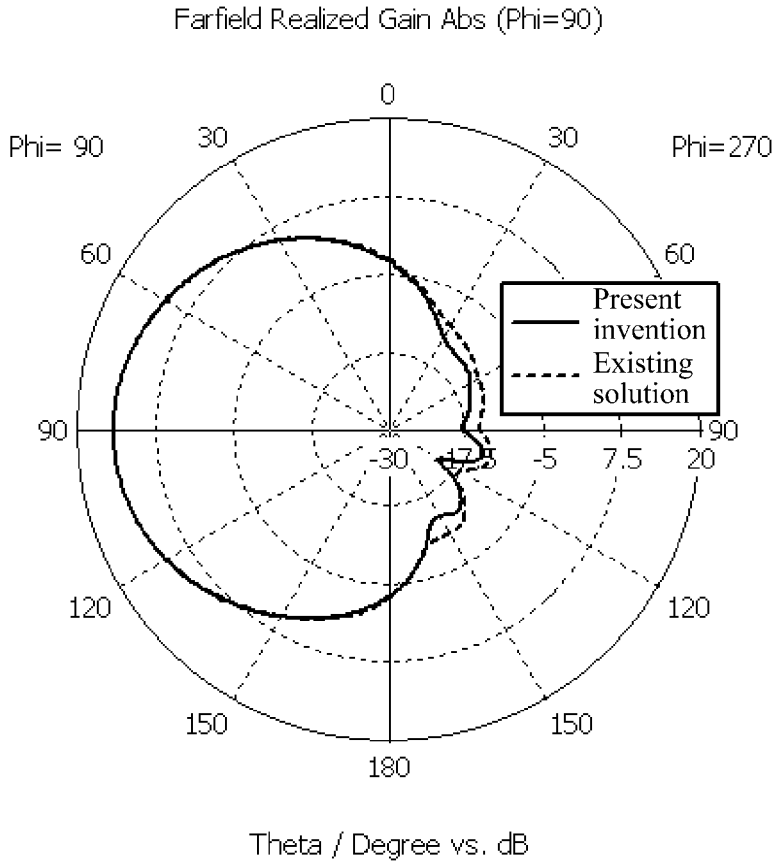
FIG. 5 is a comparison between a directivity diagram of an antenna with a wave-absorbing material according to an embodiment of the present invention and a directivity diagram of an existing antenna with no wave-absorbing material at 1990 MHz.
Figure 6:
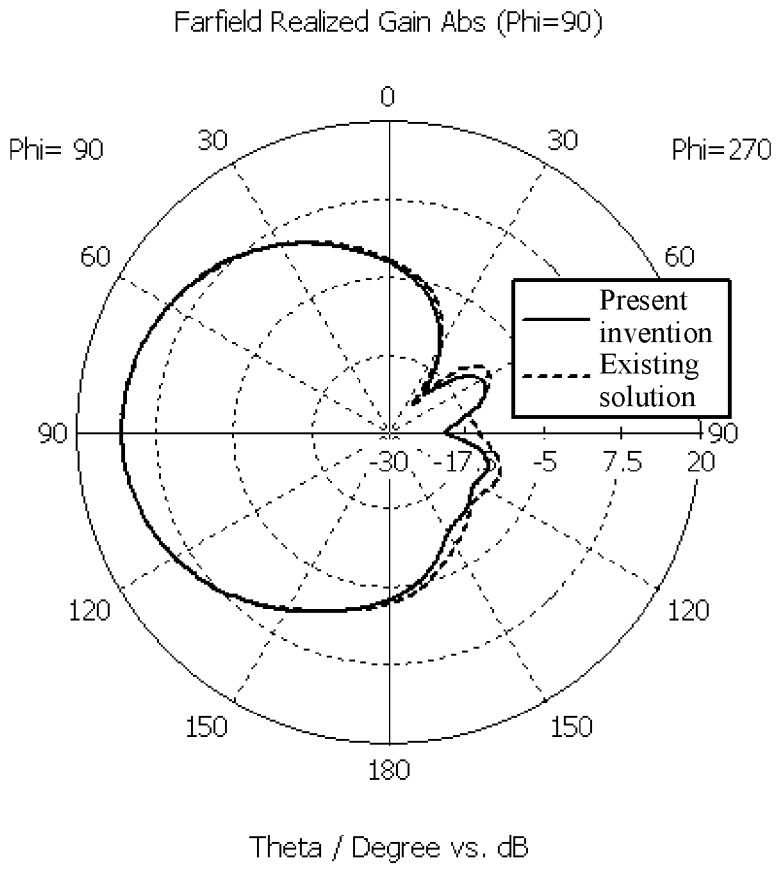
FIG. 6 is a comparison between a directivity diagram of an antenna with a wave-absorbing material according to an embodiment of the present invention and a directivity diagram of an existing antenna with no wave-absorbing material at 2170 MHz.

A beneficial effect of the present invention is to improve electrical performance of an antenna, which is specifically indicated by a front-to-rear ratio and cross-polarization isolation. FIG. 4 is a comparison between a directivity diagram of an antenna with a wave-absorbing material according to an embodiment of the present invention and a directivity diagram of an existing antenna with no wave-absorbing material at 1710 MHz. FIG. 5 is a comparison between a directivity diagram of an antenna with a wave-absorbing material according to an embodiment of the present invention and a directivity diagram of an existing antenna with no wave-absorbing material at 1990 MHz. FIG. 6 is a comparison between a directivity diagram of an antenna with a wave-absorbing material according to an embodiment of the present invention and a directivity diagram of an existing antenna with no wave-absorbing material at 2170 MHz. After the wave-absorbing material is loaded, the front-to-rear ratio is improved, and is respectively 2.15 dB, 1.51 dB, and 1.80 dB at 1710 MHz, 1990 MHz, and 2170 MHz.

Figure 7:
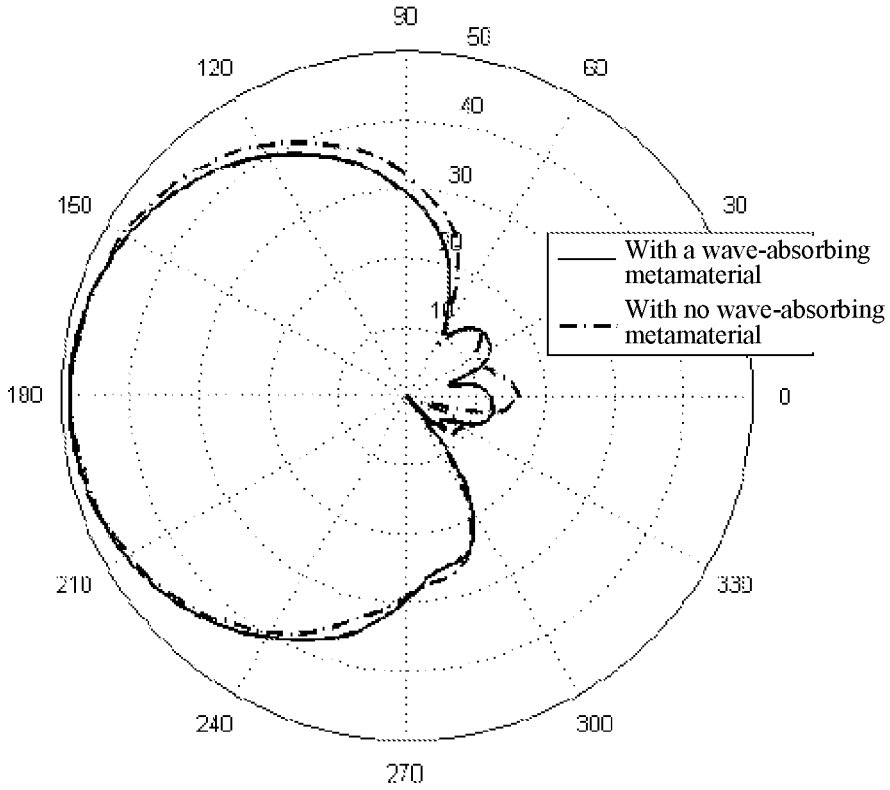
FIG. 7 is a comparison between a directivity diagram of an antenna with a wave-absorbing metamaterial according to a preferred embodiment of the present invention and a directivity diagram of an existing antenna with no wave-absorbing metamaterial at 1710 MHz.
Figure 8:
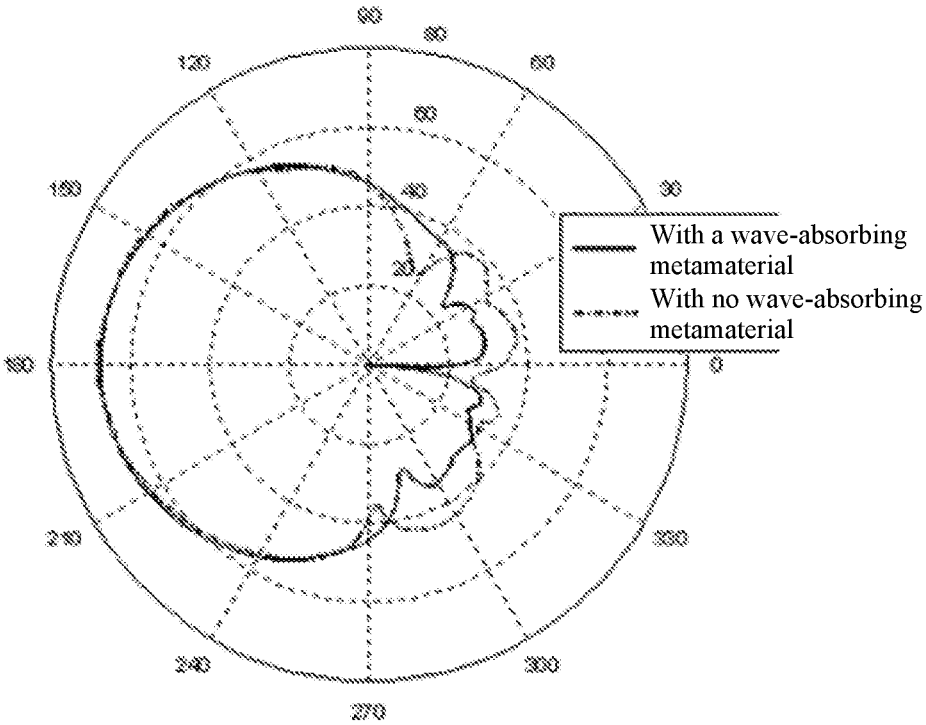
FIG. 8 is a comparison between a directivity diagram of an antenna with a wave-absorbing metamaterial according to a preferred embodiment of the present invention and a directivity diagram of an existing antenna with no wave-absorbing metamaterial at 1990 MHz.
Figure 9:
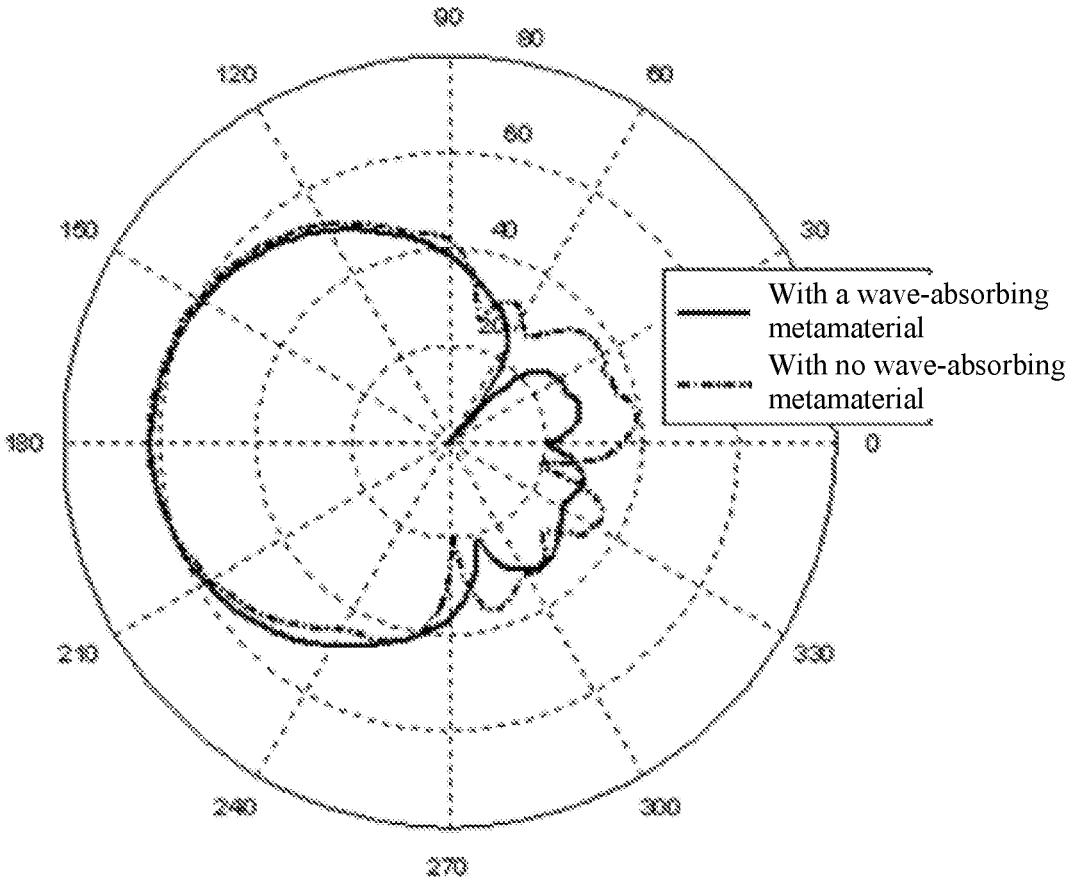
FIG. 9 is a comparison between a directivity diagram of an antenna with a wave-absorbing metamaterial according to a preferred embodiment of the present invention and a directivity diagram of an existing antenna with no wave-absorbing metamaterial at 2170 MHz.

FIG. 7 is a comparison between a directivity diagram of an antenna with a wave-absorbing metamaterial according to a preferred embodiment of the present invention and a directivity diagram of an existing antenna with no wave-absorbing metamaterial at 1710 MHz. FIG. 8 is a comparison between a directivity diagram of an antenna with a wave-absorbing metamaterial according to a preferred embodiment of the present invention and a directivity diagram of an existing antenna with no wave-absorbing metamaterial at 1990 MHz. FIG. 9 is a comparison between a directivity diagram of an antenna with a wave-absorbing metamaterial according to a preferred embodiment of the present invention and a directivity diagram of an existing antenna with no wave-absorbing metamaterial at 2170 MHz. Referring to FIG. 7 to FIG. 9, based on testing, when no wave-absorbing metamaterial is loaded, a front-to-rear ratio of an antenna is respectively 23.85 dB, 24.50 dB, and 23.18 dB at 1710 MHz, 1990 MHz, and 2170 MHz; and after a wave-absorbing metamaterial is loaded, a front-to-rear ratio of an antenna is respectively 29.83 dB, 28.17 dB, and 27.67 dB, and an increase is respectively 5.97 dB, 3.67 dB, and 4.48 dB. Therefore, in the embodiments of the present invention, electrical performance is significantly improved.

The embodiments of the present invention further have the following advantages: The wave-absorbing metamaterial and a conducting material such as copper foil for manufacturing the conductive geometric structure in the metamaterial do not significantly cause an increase in costs of raw materials; and installation is convenient, and antenna assembly difficulty is not increased. In the embodiments in which the wave-absorbing metamaterial is used, environmental adaptability of the wave-absorbing metamaterial is superior to that of a conventional wave-absorbing material.

The embodiments of the present invention may be applied to directional coverage products such as a base station antenna, a Wi-Fi antenna, an electronic toll collection ETC antenna. When the embodiments are applied to the mobile communications and wireless coverage fields, performance such as a front-to-rear ratio and cross polarization of an antenna product are improved, backward interference of a system is reduced, transmit/receive interference is reduced, a communication capacity is improved, and so on. Improvement on the front-to-rear ratio improves forward coverage of the antenna, and reduces interference of backward coverage. This is especially advantageous in an urban mobile communications and wireless coverage environment. Improvement on cross-polarization isolation can reduce interference of a transmit antenna on a receive antenna, because there may be orthogonal polarization between the transmit antenna and the receive antenna. Improvement on cross polarization may further improve a communication capacity.

Although the present invention is described with reference to the current specific embodiments, a person of ordinary skill in the art should be aware that the foregoing embodiments are merely used to describe the present invention, and various equivalent modifications or replacements may be made without departing from the spirit of the present invention. Therefore, modifications and variations made to the foregoing embodiments within the essential spirit and scope of the present invention shall fall within the scope of the claims of this application.

What is claimed is:

1. An antenna, comprising an antenna element and a reflection panel, wherein the antenna element is disposed on the reflection panel, the antenna further comprises a wave-absorbing material layer, the wave-absorbing material layer is disposed on one side of an outer surface, back to the antenna element, of the reflection panel;

wherein the wave-absorbing material layer comprises a magnetic electromagnetic wave-absorbing material layer and a conductive geometric structure layer combined with the magnetic electromagnetic wave-absorbing material layer, the conductive geometric structure layer is formed by a plurality of conductive geometric structure units that are arranged sequentially, each conductive geometric structure unit comprises an unclosed ring-shaped conductive geometric structure, and two relatively parallel strip-shaped structures are disposed at an opening of the ring-shaped conductive geometric structure.

2. The antenna according to claim 1, wherein the wave-absorbing material layer is attached to the outer surface, back to the antenna element, of the reflection panel; or the wave-absorbing material layer is disposed on the outer surface, back to the antenna element, of the reflection panel with a spacing.

3. The antenna according to claim 1, wherein the antenna further comprises a radome, the antenna element and the reflection panel are disposed in the radome, and the wave-absorbing material layer is disposed between the radome and the reflection panel;

wherein the reflection panel has a base panel, a first side panel, and a second side panel; locations of the first side panel and the second side panel are opposite to each other; the antenna element is disposed on the base panel; the radome encloses at least the base panel, the first side panel, and the second side panel; and the wave-absorbing material layer is disposed at least between the radome and the first side panel and between the radome and the second side panel;

wherein the wave-absorbing material layer is attached to an outer surface, opposite to the radome, of the first side panel, and is attached to an outer surface, opposite to the radome, of the second side panel; or the wave-absorbing material layer is attached to an inner surface, opposite to the first side panel and the second side panel, of the radome.

4. The antenna according to claim 3, wherein the wave-absorbing material layer is further disposed between the radome and the base panel.

5. The antenna according to claim 4, wherein the wave-absorbing material layer is attached to an outer surface, opposite to the radome, of the base panel; or the wave-absorbing material layer is attached to an inner surface, opposite to the base panel, of the radome.

6. The antenna according to claim 5, wherein the wave-absorbing material layer is combined with a metal layer, and the metal layer is disposed on the inner surface, opposite to the first side panel and the second side panel, of the radome.

7. The antenna according to claim 6, wherein the metal layer is further disposed on the inner surface, opposite to the base panel, of the radome.

8. The antenna according to claim 1, wherein there are a plurality of antenna elements that form an element array; the wave-absorbing material layer covers an outer surface of an area, on the reflection panel, that is corresponding to the element array; and layout of the wave-absorbing material layer is centered around the element array.

9. The antenna according to claim 1, wherein the ring-shaped conductive geometric structure has more than one opening.

10. The antenna according to claim 1, wherein the ring-shaped conductive geometric structure is in a circular, oval, triangular, or polygonal shape.

11. The antenna according to claim 1, wherein the conductive geometric structure units are arranged in a form of a periodic array.

12. The antenna according to claim 1, wherein a metal layer is disposed on a surface of the magnetic electromagnetic wave-absorbing material layer.

13. The antenna according to claim 12, wherein the magnetic electromagnetic wave-absorbing material layer is a wave-absorbing patch material.

14. The antenna according to claim 12, wherein an operating frequency of the wave-absorbing material layer is within a frequency band of 0.8-2.7 GHz, and a thickness of the metal layer is greater than a skin depth, corresponding to the operating frequency band, of the metal layer.

15. The antenna according to claim 1, wherein the conductive geometric structure units are attached to the magnetic electromagnetic wave-absorbing material layer or are embedded in the magnetic electromagnetic wave-absorbing material layer.

16. The antenna according to claim 1, wherein the conductive geometric structure unit is in a shape having a circumcircle, and a diameter of the circumcircle is 1/20-1/5 of an electromagnetic wavelength in an operating frequency band free space.

17. The antenna according to claim 1, wherein an operating frequency of the wave-absorbing material layer is within a frequency band of 0.8-2.7 GHz, a thickness of the conductive geometric structure unit is greater than a skin depth, corresponding to the operating frequency band, of the conductive geometric structure unit.

18. The antenna according to claim 1, wherein line widths of the ring-shaped conductive geometric structure and the strip-shaped structure are both W, and $0.1\ \text{mm} \leq W \leq 1\ \text{mm}$.

19. The antenna according to claim 1, wherein thicknesses of the ring-shaped conductive geometric structure and the strip-shaped structure are both H, and $0.005\ \text{mm} \leq H \leq 0.05\ \text{mm}$.

* * * * *